US007887924B2

(12) United States Patent
Urushihara et al.

(10) Patent No.: US 7,887,924 B2
(45) Date of Patent: Feb. 15, 2011

(54) HIGH-STRENGTH STEEL WITH EXCELLENT UNSUSCEPTIBILITY TO HYDROGEN EMBRITTLEMENT

(75) Inventors: Wataru Urushihara, Kobe (JP); Toshiki Sato, Kobe (JP); Nao Yoshihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 445 days.

(21) Appl. No.: 11/994,436

(22) PCT Filed: Jan. 15, 2007

(86) PCT No.: PCT/JP2007/050443

§ 371 (c)(1),
(2), (4) Date: Jan. 2, 2008

(87) PCT Pub. No.: WO2007/083604

PCT Pub. Date: Jul. 26, 2007

(65) Prior Publication Data

US 2009/0035602 A1 Feb. 5, 2009

(30) Foreign Application Priority Data

Jan. 20, 2006 (JP) ..... 2006-012089

(51) Int. Cl.
*B32B 15/18* (2006.01)
*C22C 38/18* (2006.01)

(52) U.S. Cl. ..... 428/471; 148/333; 148/908; 420/84; 420/104

(58) Field of Classification Search ..... 420/84, 420/104–129; 148/908, 320, 333–336, 537; 428/471

See application file for complete search history.

(56) References Cited

U.S. PATENT DOCUMENTS 5,776,267 A 7/1998 Nanba et al.

FOREIGN PATENT DOCUMENTS

| | | | |
|---|---|---|---|
| EP | 1 676 932 | A1 | 7/2006 |
| JP | 63-227748 | | 9/1988 |
| JP | 9-41079 | | 2/1997 |
| JP | 10-1746 | | 1/1998 |
| JP | 10-110247 | | 4/1998 |
| JP | 2001-358003 | | 12/2001 |
| JP | 2003-105485 | | 4/2003 |
| JP | 2004-307923 | * | 11/2004 |

(Continued)

*Primary Examiner*—Deborah Yee
(74) *Attorney, Agent, or Firm*—Oblon, Spivak, McClelland, Maier & Neustadt, L.L.P.

(57) ABSTRACT

A high-strength steel excellent in hydrogen embrittlement resistance is provided. The high-strength steel of the present invention excellent in hydrogen embrittlement resistance has a tensile strength of 1800 N/mm$^2$ or above, contains 0.3 to 0.7% (percent by mass) C, 0.95 to 5.0% Cr, not higher than 0.6% and higher than 0% Mn, and 0.7 to 2.5% Si, and contains at least one of Mg, Ca, Sr, Ba, Li, Na and K so as to meet the following conditions:

(1) the upper limits of the Mg, the Ca, the Sr, the Ba, the Li, the Na and the K content are 0.05%, and (2) the Mg, the Ca, the Sr, the Ba, the Li, the Na and the K content meet Expression (1):

$$Cr + \frac{Mn}{4} \leq 1000 \times \left[Ca + \frac{Mg + Sr + Ba}{2} + \frac{Li + Na + K}{8}\right]. \quad (1)$$

10 Claims, 2 Drawing Sheets

FOREIGN PATENT DOCUMENTS

| | | |
|---|---|---|
| JP | 2004-332099 | 11/2004 |
| JP | 2005-320602 | 11/2005 |
| JP | 2006-219709 | 8/2006 |
| SU | 1316285 | * 10/1994 |

* cited by examiner

HIGH-STRENGTH STEEL WITH EXCELLENT UNSUSCEPTIBILITY TO HYDROGEN EMBRITTLEMENT

TECHNICAL FIELD

The present invention relates to a high-strength steel for structural and machine structural uses, such as transportation machines. More particularly, the present invention relates to a high-strength steel having a tensile strength not lower than 1800 N/mm$^2$ and excellent in hydrogen embrittlement resistance, such as a spring steel for suspension springs.

BACKGROUND ART

Improvement of hydrogen embrittlement resistance is an important problem with a high-strength steel, such as a steel having a tensile strength not lower than 1800 N/mm$^2$. Hydrogen embrittlement resistance is a property of a steel resistant to time-dependent fracture due to embrittlement of the steel resulting from absorption of hydrogen during use. Various studies have been made to improve hydrogen embrittlement resistance. It is considered, in recent years, that increase in the hydrogen content of a steel with time resulting from the increase of hydrogen penetrated into the steel and capable of moving in the steel, namely, diffusible hydrogen, is one of factors of brittle fracture. Efforts have been made to prevent the embrittlement of a steel by trapping diffusible hydrogen. For example, a technique disclosed in Patent Reference 1 traps hydrogen by precipitating a carbonitride in the layer structure of tempered martensite and ferrite to prevent fatigue fracture.

There are many proposals to use precipitates capable of trapping hydrogen. Technique disclosed in Patent Reference 2 suppresses hydrogen embrittlement by trapping hydrogen with carbonitride of Ti, Nb, Zr, Ta, Hf or Mo.

[Patent Reference 1] JP-A-2003-105485

[Patent Reference 2] JP-A-10-110247

DISCLOSURE OF THE INVENTION

Problem to be Solved by the Invention

Under the circumstances, it is an object of the present invention to provide a high-strength steel more excellent in hydrogen embrittlement resistance than conventional steels.

A high-strength steel excellent in hydrogen embrittlement resistance in a first aspect of the present invention has a tensile strength not lower than 1800 N/mm$^2$, a C content between. 0.3 and 0.7% (percent by mass), a Cr content between 0.95 and 5.0%, a Mn content not higher than 0.6% and higher than 0%, and a Si content between 0.7 and 2.5%, and contains at least one of Mg, Ca, Sr, Ba, Li, Na and K so as to meet the following conditions:

(1) the upper limit of the Mg, the Ca, the Sr, the Ba, the Li, the Na and the K content is 0.05%, and (2) the Mg, the Ca, the Sr, the Ba, the Li, the Na and the K content meet Expression (1):

$$Cr + \frac{Mn}{4} \leq 1000 \times \left[Ca + \frac{Mg + Sr + Ba}{2} + \frac{Li + Na + K}{8}\right] \quad (1)$$

where Cr, Mn, Ca, Mg, Sr, Ba, Li, Na and K represent the Cr, the Mn, the Ca, the Mg, the Sr, the Ba, the Li, the Na and the K content in percent by mass, respectively, of the high-strength steel.

The high-strength steel may have a N content between 0.002 and 0.010%, an O content between 0.0005 and 0.005% and a S content between 0.001 and 0.025% and may meet at least either of the following conditions (a) and (b):

(a) the high-strength steel further contains at least one of Ti, Zr, Hf and Nb in a content between 0.030 and 0.50%, and (b) the high-strength steel further contains B in a content between 0.0005 and 0.01%.

The high-strength steel of the present invention may further contain V and/or Mo in a content not higher than 2% and higher than 0%, Ni in a content not higher than 2.0% and higher than 0% and/or Cu in a content not higher than 1.0% and higher than 0%.

The high-strength steel of the present invention has a fracture toughness (KIC) of, for example, about 40 MPa√m or above.

A high-strength steel excellent in hydrogen embrittlement resistance in a second aspect of the present invention has a tensile strength not lower than 1800 N/mm$^2$, a C content between. 0.3 and 0.7%, a Cr content between 0.95 and 5.0%, a Mn content not higher than 0.6% and higher than 0%, and a Si content between 0.7 and 2.5%, has a continuous or discontinuous compound layer forming a surface and containing at least one of Mg, Ca, Sr, Ba, Li, Na and K, and the compound layer occupies 20% of a unit length of a section of the steel in an observation field or above. Preferably, the compound layer contains $Mg(OH)_2$ and $CaCo_3$.

A high-strength steel in a third aspect of the present invention may be obtained by forming the compound layer of the high-strength steel in the second aspect of the present invention in the surface of the high-strength steel in the first aspect of the present invention. The high-strength steel in the third aspect of the present invention has improved hydrogen embrittlement resistance. A spring made of one of the high-strength steels in the first, the second and the third aspect is also intended to be within the scope of the present invention.

Effect of the Invention

The present invention successfully balanced corrosion resistant elements and elements effective in suppressing corrosion pitting to provide the high-strength steel excellent in hydrogen embrittlement resistance as compared with conventional high-strength steels. Coating the surface of the steel with the compound layer containing the specified elements can suppress corrosion pitting, whereby the hydrogen embrittlement resistance of the steel can be enhanced regardless of the composition of the steel. The compound layer formed on the surface of the steel piece of the steel excellent in hydrogen embrittlement resistance improves the hydrogen embrittlement resistance of the steel. Thus the present invention provides a high-strength steel having high strength and excellent hydrogen embrittlement resistance.

BEST MODE FOR CARRYING OUT THE INVENTION

Figure 1:
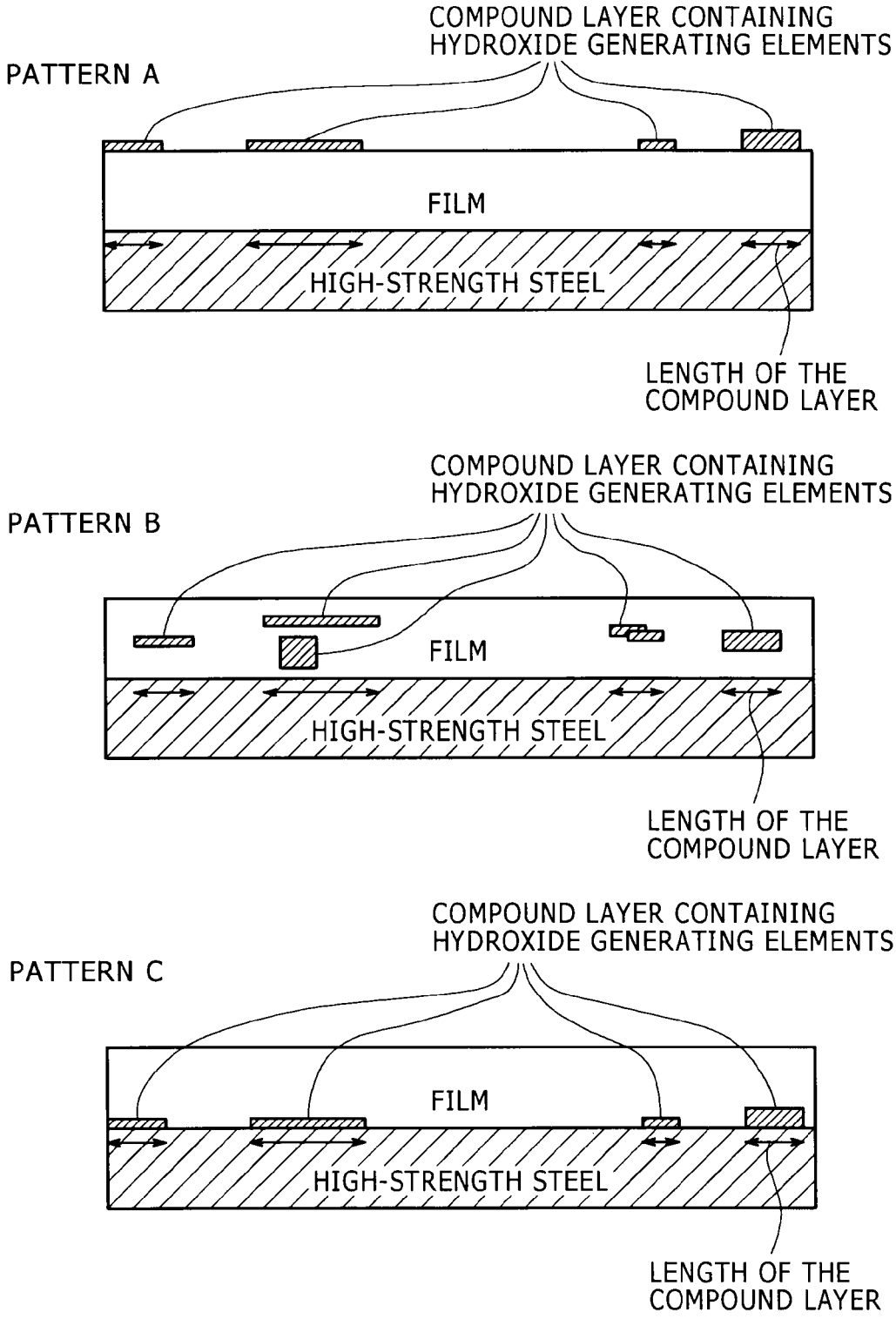
FIG. 1 is a typical sectional view of assistance in explaining discontinuous compound layer containing an element capable of forming a hydroxide.

The inventors of the present invention examined high-strength steels in an effort to reduce the cost of high-strength steels, to enhance the strength, and to reduce the amount of diffusible hydrogen by improving corrosion resistance to prevent the penetration of hydrogen into the high-strength steels. The inventors conducted experiments to increase the Cr content, namely, corrosion resistance improving element content, of steels. The experiments showed that there is strong correlation between corrosion resistance and hydrogen embrittlement resistance, and there is a tendency for the hydrogen embrittlement resistance of the steel to deteriorate despite the improvement of the corrosion resistance of the steel when the Cr content of the steel increases a predetermined limit. It was found that the improvement of corrosion resistance was not necessarily accompanied by the improvement of hydrogen embrittlement resistance.

More concretely, experiments for increasing the Cr content of the steel proved that, when the Cr content was increased beyond 0.3%, the corrosion resistance was enhanced with the increase of the Cr content and the hydrogen embrittlement resistance deteriorated with the increase of the Cr content. That is, the penetration of hydrogen into the steel cannot be reduced even if the Cr content is increased to enhance the corrosion resistance. The inventors of the present invention made further studies and found that when once corrosion pits are formed in a surface layer of a steel, the pH of water collected in the bottoms of the corrosion pits decreases sharply and hydrogen is generated even if the steel has high corrosion resistance, and the decrease of the pH promotes corrosion to increase the depth of the pits. Consequently, penetration of hydrogen into the steel increases and the deterioration of the hydrogen embrittlement resistance are promoted.

The inventors of the present invention found through further studies that the formation of corrosion pits and the progress of corrosion can be suppressed by adding a hydroxide generating element to a steel or by forming a layer containing a hydroxide generating element in the surface of the steel, and the penetration of hydrogen into the steel can be suppressed. The present invention was made on the basis of findings obtained by the experiments. In the following description, a high-strength steel piece of a high-strength steel containing a hydroxide generating element will be referred to as a first high-strength steel, an article formed of the first high-strength steel will be referred to as a first high-strength steel piece, a high-strength steel piece of a high-strength steel provided with a hydroxide generating element containing layer in its surface will be called a second high-strength steel piece, the high-strength steel forming the second high-strength steel piece will be referred to as a second high-strength steel, and a high-strength steel piece of a high-strength steel formed by forming a layer containing hydroxide generating elements on a surface of the first high-strength steel piece will be called a third high-strength steel piece.

The high-strength steels forming the first and the second high-strength steel piece need to have a tensile strength not lower than 1800 N/mm$^2$, preferably 1900 N/mm$^2$ or above, most desirably, 1950 N/mm$^2$. It is an object of the present invention to enhance the hydrogen embrittlement resistance of a steel having a very high tensile strength. The high-strength steels may have a higher tensile strength on the order of, for example, 2500 N/mm$^2$. A high-strength steel having a predetermined tensile strength can be obtained by processing a steel by heat treatments for quenching and tempering defined by properly determining conditions.

Both the first and the second high-strength steel have a fracture toughness (KIC) of 40 MPa$\sqrt{m}$ or above, preferably, 45 MPa$\sqrt{m}$ or above, most desirably, 50 MPa$\sqrt{m}$ or above. High-strength steels of the present invention having strength and fracture toughness of levels not lower than those of foregoing strength and toughness can satisfy properties required of recent high-strength spring steels for springs. Although there is no upper limit for fracture toughness, the upper limit for fracture toughness is on the order of 60 MPa $\sqrt{m}$ inmost cases. The present invention may be applied to cases not meeting required conditions for fracture toughness.

The first and the second high-strength steel contain C, which is an element essential to improving the hardenability and enhancing the strength of steels. Carbon makes a hydroxide generating element, which is difficult to be dissolved in steels, stably exist in a carbide or a composite compound. To make C demonstrate its ability to ensure a desired strength and to form a carbide, the C content of steels is 0.3% or above, desirably, 0.35% or above. Toughness decreases, hydrogen embrittlement resistance deteriorates and cold-workability tends to deteriorate if the C content is excessively high. Therefore it is desirable that the C content is 0.7% or below, desirably, 0.65% or below.

It is an indispensable condition that the first and the second high-strength steel of the present invention contain Cr. Chromium is an inexpensive element having the effects of enhancing the strength of steels, providing high corrosion resistance and reducing corrosion rate. To make Cr demonstrate the foregoing effect, the Cr content needs to be 0.95% or above. The lower limit of the Cr content may be raised when necessary; the lower limit of the Cr content may be, for example, on the order of 1.0% or on the order of 1.5%. There is a tendency that corrosion pits are liable to be formed as the Cr content increases. Although Cr enhances the corrosion resistance of the steel, Cr also has an effect on reducing the pH of a liquid collected in the bottoms of corrosion pits. It is considered that, once corrosion pits are formed, the depth of the corrosion pits increases with time. Therefore, the Cr content is 5.0% or below to suppress the adverse influence of Cr on hydrogen embrittlement resistance. Preferably, the upper limit of the Cr content is 4.0%, more desirably, 3.0%.

Manganese (Mn) also is an essential component of the first and the second high-strength steel of the present invention. The Mn content needs to be higher than 0%. Although Mn does not contribute significantly to improving corrosion resistance, Mn contributes to enhancing strength. In view of the refining efficiency of a practical refining work, the lower limit of Mn content is 0.05% or above, such as 0.1% or above, desirably, 0.2% or above. There is a tendency that corrosion pits are liable to be formed as the Mn content increases similarly to the case with Cr. To reduce the adverse effect of Mn on hydrogen embrittlement resistance, the Mn content is 0.6% or below. A preferably upper limit of the Mn content is 0.5%.

Silicon (Si) also is an essential component of the first and the second high-strength steel of the present invention. Silicon contributes as a solid solution hardening element to improve strength and contributes as a rust densifying element to improve corrosion resistance. When Si content is below 0.7%, matrix strength is insufficient and corrosion resistance is low. When the Si content is above 2.5%, a carbide cannot satisfactorily dissolve in the steel during rolling and during heating for quenching. When the high-strength steel is intended to be used as a spring steel, in particular, the steel needs to be heated at a high temperature to austenitize the steel uniformly. When the steel having a Si content above 2.5% is thus heated at a high temperature, excessive decarbonization occurs in the surface of a spring made of the high-strength steel and the fatigue characteristic of the spring deteriorates. Thus, a desirable Si content is between 0.7 and 2.5%, preferably, between about 0.9 and about 2.2%, more desirably between about 1.0 and about 2.0%.

The hydrogen embrittlement resistance of the first high-strength steel of the present invention is improved by properly determining the chemical composition of the high-strength steel. The first high-strength steel contains at least one of Mg, Ca, Sr, Ba, Li, Na and K so as to meet the following conditions:

(1) the upper limit of the Mg, the Ca, the Sr, the Ba, the Li, the Na and the K content is 0.05%, and (2) the Mg, the Ca, the Sr, the Ba, the Li, the Na and the K content meet Expression (2):

$$Cr + \frac{Mn}{4} \leq 1000 \times \left[Ca + \frac{Mg + Sr + Ba}{2} + \frac{Li + Na + K}{8}\right] \quad (2)$$

where Cr, Mn, Ca, Mg, Sr, Ba, Li, Na and K represent the Cr, the Mn, the Ca, the Mg, the Sr, the Ba, the Li, the Na and the K content in percent by mass, respectively, of the high-strength steel.

Note that the hydrogen embrittlement resistance of the second high-strength steel is improved by the presence of a specified compound layer in its surface and the composition of the rest of the hydroxide generating elements other than the C, the Cr, the Mn and the Si content of the steel is not particularly limited.

All the elements Mg, Ca, Sr, Ba, Li, Na and K are capable of forming a hydroxide. Those elements will be referred to as "hydroxide generating elements". Those elements contained in the steel react with water and produce alkaline hydroxides. Hydroxide ions, namely, $OH^-$ groups, produced by those hydroxides neutralize ions of the liquid on the surface of the high-strength steel piece to prevent the reduction of pH. Consequently, corrosion pitting can be suppressed, and further increase in the depth of corrosion pits due to the progressive corrosion of the bottoms of the corrosion pits can be suppressed. The hydroxide generating elements react with water to prevent the penetration of hydrogen produced from water in a corrosive environment into the high-strength steel. Even if the composition of the steel becomes susceptible to corrosion pitting due to the addition of Cr and Mn to the steel, the hydroxide generating elements suppress corrosion pitting and the growth of corrosion pits formed in the steel piece. Such an effect of Ca contained in rust is particularly significant. Rust containing Ca is effective in suppressing corrosion pitting and the growth of corrosion pits. The effect of the hydroxide generating elements on increasing the pH of the liquid in the depth of corrosion pits is significant when the hydrogen ion concentration of the liquid is pH 3 or below. The utility of the present invention is significant with steels having a composition having a comparatively high Cr and Mn content and susceptible to corrosion pitting and with high-strength steel pieces of the high-strength steels intended for use in a highly corrosive environment.

Suppose that the high-strength steel is expected to be used as a spring steel for forming springs. If corrosion pits are formed excessively in a spring, the corrosion pits promote the development and growth of cracks and the fatigue characteristic is deteriorated remarkably even if the spring has high fracture toughness because the spring is repeatedly stressed. Therefore, the suppression of corrosion pitting is important particularly with high-strength spring steels.

The condition (1) requires the upper limit of the hydroxide generating element content to be 0.005%. Each of those hydroxide generating elements produces hydroxide ions to suppress the formation and growth of corrosion pits. The corrosion pitting suppressing effect of the hydroxide generating element increases with the increase of its content. On the other hand, since the hydroxide generating element is highly reactive with impurities contained in a molten steel, it is possible that the hydroxide generating element generates large compound particles in the steel and to cause a significant loss in manufacturing the steel. When the hydroxide generating element is contained in a high content in the steel, large deposit particles are produce in the steel. Such large deposit particles cause stress concentration, strain caused by the large deposit particles increases the hydrogen content and reduces the hydrogen embrittlement resistance. Each of those hydroxide generating elements has a low melting point and a low boiling point, and has a low solubility with the steel. Therefore, even if a large amount of the hydroxide generating element is added to the steel, only a small amount of the hydroxide generating element remains in the steel. From this viewpoint, the upper limit of the hydroxide generating element content is 0.05%, preferably, 0.01%, more desirably, 0.005%. The respective amounts of the hydroxide generating elements added to the steel are subject to restrictions placed by Expression (2). However, it is desirable that the hydroxide generating element contents are not higher than the lowest necessary contents defined by Expression (2) plus 0.002%.

The condition (2) specifies relation among the hydroxide generating element contents of the high-strength steel by Expression (below) because it is desirable to change the hydroxide generating element contents according to the respective amounts of Cr and Mn that promote corrosion pitting.

$$Cr + \frac{Mn}{4} \leq 1000 \times \left[Ca + \frac{Mg + Sr + Ba}{2} + \frac{Li + Na + K}{8}\right] \quad (3)$$

where Cr, Mn, Ca, Mg, Sr, Ba, Li, Na and K represent the Cr, the Mn, the Ca, the Mg, the Sr, the Ba, the Li, the Na and the K content in percent by mass, respectively, of the high-strength steel.

In the left side of Expression (3), it is supposed that the degree of adverse effect of Cr is "1". Then, the degree of adverse effect of Mn is "¼". Therefore, Cr and Mn/4 are added. In the right side of Expression (3) it is supposed that the degree of contribution of the corrosion pitting suppressing effect of Ca is "1". Then, the respective degrees of contribution of the corrosion pitting suppressing effects of Mg, Sr and Ba are "½", and those of Li, Na and K are "⅛". The hydroxide generating element contents needs to be determined so that a value obtained by multiplying the value of the right side by 1000 is not smaller than the value of the left side. When the condition represented by expression (3) is satisfied, corrosion resistance and strength provided by Cr and Mn, and corrosion pitting suppressing effect provided by the hydroxide generating elements are well balanced. A state where the left side is greater than the right side is undesirable, because in such a state, the corrosion pitting suppressing effect is insufficient, the amount of hydrogen penetrating into the steel increases and the hydrogen embrittlement resistance of the steel is deteriorated.

The second high-strength steel piece of the second high-strength steel has a compound layer containing the hydroxide generating elements in its surface. The compound layer containing the hydroxide generating elements and formed in the second high-strength steel piece prevents the penetration of hydrogen into the second high piece, suppresses the formation and growth of corrosion pits, and improves the hydrogen embrittlement resistance of the second high-strength steel piece. Therefore, although the C, the Cr, the Mn and the Si content of the steel useful for enhancing strength, fracture toughness and corrosion resistance are required to meet the foregoing condition, the composition of the rest of the hydroxide generating elements is not an essential condition.

The compound layer containing the hydroxide generating elements can be formed on the surface of the steel piece by an electrochemical process or a vapor-phase coating process. The electrochemical process immerses the steel piece in a solution having, for example, a Ca ion concentration of 1 g/l or above and a Mg ion concentration of 1 g/l, connects the steel piece to a negative electrode, and supplies a current of 1 $A/dm^2$ or above to the steel piece. Consequently, a layer of a mixture of $CaCO_3$ and $Mg(OH)_2$ is formed on the surface of the steel piece. The vapor-phase coating process may form an oxide film containing oxides of the hydroxide generating elements by a known coating process, such as a CVD process, a vacuum evaporation process, a sputtering process or a PVD process, such as a ion plating process. Desirably, the thickness of the compound layer is 0.1 μm or above, more desirably, 1 μm or above.

The compound layer containing the hydroxide generating elements may be formed directly on the surface of the steel piece or on another film for other purposes (referred to simply as "film") formed on the surface of the steel piece. The compound layer may be coated with the film. If plural other films are formed in layers, plural compound layers may be formed each between the adjacent ones of other films. FIG. 1 shows examples of patterns. In a pattern A, a high-strength steel piece is coated with a film, and a discontinuous compound layer containing hydroxide generating elements is formed on the film. In a pattern B, a high-strength steel piece is coated with a film, and a discontinuous compound layer containing hydroxide generating elements is formed in the film. In a pattern C, a discontinuous compound layer containing hydroxide generating elements is formed on a surface of a high-strength steel piece and is coated with a film. What is essential is that the surface of the high-strength steel piece is isolated from air by the compound layer. There is not any particular restrictions on the film for other purposes and the film may be any one of films including, for example, oxide films formed when the high-strength steel piece is subjected to a heat treatment for adjusting the strength of the high-strength steel piece and the structure of the high-strength steel, lubricating films formed when the high-strength steel piece is processed and paint films.

A thick, dense compound film covering a surface of a steel piece entirely has a strong effect on suppressing the formation and growth of corrosion pits. From the viewpoint of characteristics relating to appearance, dimensional accuracy and coating conformability required of the high-strength steel piece, there are many cases in which it is undesirable to coat the surface of the steel piece entirely. In such cases, it is desirable to coat the surface partially with the compound layer. However, since it is possible that the corrosion pitting suppressing effect of the compound layer is insufficient if the compound layer is discontinuous, it is necessary that the ratio of the total length of parts of the discontinuous compound layer in a section of the steel piece in an observation field to the length of the section in the observation field (which will be referred to as "unit length") is 20% or above. A specimen is prepared by embedding a sample steel piece in a resin block or the like, the section of the steel piece in the specimen is mirror-finished, and the mirror-finished surface is analyzed for element mapping by EPMA at a magnification between 1000× and 10000×. The element mapping of the section of the sample indicates the elements contained in the compound layer by lateral lines. The lengths of the lateral lines are measured and are summed up to determine a total length. The length of the section of the sample in the observation field is between about 10 and 100 μm. The ratio of the total length to the unit length is calculated. Preferably, at least three specimens of a sample steel piece is prepared, and at least five parts of each specimen are observed in five observation fields for element mapping, and the ratio of the total length to the unit length is determined by calculating the mean of the measured data on the three specimens. Some parts of one compound layer and some parts of the other compound layer overlap each other in some cases. In such cases, the overlapping parts are counted only once as will be understood from the pattern B shown in FIG. 1.

The ratio of the total length of the compound layer to the length of the specimen will be referred to as "surface treatment length ratio". When the surface treatment length ratio is below 20%, the corrosion pitting suppressing effect of the compound layer is insufficient. Although the compound layer formed in a larger surface treatment length ratio (compound layer to surface ratio), has a stronger corrosion pitting suppressing effect, the foregoing characteristics required of the high-strength steel piece deteriorates if the surface treatment length ratio is excessively high. It is desirable to determine the surface treatment length ratio taking into consideration uses of the high piece and an environment in which the high-strength steel piece is to be used. From the viewpoint of the corrosion pitting suppressing effect, it is preferable that the surface treatment length ratio is 25% or above, desirably, 40% or above, and may be 60% or above. From the view point of preventing the deterioration of the characteristics required of the high-strength steel piece, it is preferable that the surface treatment length ratio is 90% or below, desirably, 70% or below, and may be 50% or below. Those upper limits and those lower limits may be selectively used in combination taking into consideration uses of the high-strength steel piece and an environment in which the high-strength steel piece is to be used. For example, if the high-strength steel piece is a spring, parts of the spring other than end parts of the spring, for which dimensional accuracy is important, may be coated with the compound layer.

The second high-strength steel piece made of the second high-strength steel has a surface coated with the compound layer. If the high-strength steel does not contain any hydroxide generating elements, the growth of corrosion pits cannot be suppressed when corrosion develops and the bottoms of corrosion pits penetrate into the high-strength steel piece. Therefore, it is desirable to use the third high-strength steel piece of the third high-strength steel formed by forming the compound layer containing the hydroxide generating elements on the surface of the first high-strength steel piece to suppress corrosion pitting and the growth of corrosion pits and to provide a high-strength steel piece having further improved hydrogen embrittlement resistance.

The respective ranges of the N, the O and the S content of the first and the second high-strength steel may be properly controlled, and the first and the second high-strength steel may properly contain V, Mo, Ti, Zr, Hf, Nb, B, Ni and/or Cu when necessary. The respective amounts of those elements contained in the high-strength steel may meet the following conditions.

(i) N content is 0.02% or below and above 0%, preferably, 0.015% or below.

(ii) O content is 0.02% or below and above 0%, preferably, 0.01% or below.

(iii) S content is 0.1% or below and above 0%, preferably, 0.05% or below.

(iv) Sum of or the sum of some of Ti content, Zr content, Hf content and Nb content is 0.50% or below and above 0%.

(v) B content is 0.01% or below and above 0%.

(vi) Sum of or either of V content and Mo content is 3% or below and above 0%, preferably 2.5% or below.

(vii) Ni content is 2% or below and above 0% and/or Cu content is 1% or below and above 0%.

Those elements may be contained in the high-strength steel singly or in combination so as to meet the conditions (i) to (vii).

The hydrogen embrittlement resistance of the first and the second high-strength steel can be further enhanced by properly adding those elements in combination so as to meet the conditions (i) to (vii). High-strength steels containing those elements in combination in optimum ones of the values specified by the conditions (i) to (vii) will be called special steels. Elements contained in the special steels and the element contents of the special steels will be described.

Conditions (i), (ii) and (iii) for N, O and S The N, the O and the S content of the special steel are minutely controlled. Those elements are important for precipitating nitrides, oxides, sulfides of the hydroxide generating elements and composite compounds of those oxides, nitrides and sulfides in the steel. Those elements are capable of stably retaining the hydroxide generating elements, which are difficult to retain in the steel because of their low molting points and boiling points. However, a deposit is precipitated in large particles if the N, the O and the S content is excessively high. Therefore, it is desirable that ranges for the N, the O and the S content for the special steels are narrower than those for ordinary steels. Desired ranges for the N, the O and the S content are as follows.

N content: 0.002 to 0.010%

Nitrogen forms nitrides of the hydroxide generating elements and stably disperses the nitrides in small particles. The N content is 0.002% or above. Preferable lower limit is 0.004%. The deposit is precipitated in large particles if the N content is excessively high. Therefore, the N content is 0.010% or below. A preferable upper limit N content is 0.007%.

O content: 0.0005 to 0.005%

Oxygen forms oxides of the hydroxide generating elements and stably disperses the oxides in small particles. The O content is 0.0005% or above. A preferable lower limit 0 content is 0.001%. The deposit is liable to be precipitated in large particles if the O content is excessively high. Therefore, the O content is 0.005% or below. A preferable upper limit O content is 0.003%.

S content: 0.001 to 0.005%

Sulfur forms sulfides of the hydroxide generating elements and stably disperses the sulfides in small particles. The S content is 0.001% or above. A preferable lower limit S content is 0.003%. Large particles of MnS having a low hydrogen trapping ability are precipitated if the S content is excessively high. Therefore, the S content is 0.025% or below. A preferable upper limit S content is 0.015%.

Conditions (iv) for Ti, Zr, Hf and Nb and Condition (v) for B

Either of the sum of the Ti, the Zr, the Hf and the Nb content meeting the condition (iv) and the B content meeting the condition (v), preferably, both the sum of the Ti, the Zr, the Hf and the Nb content meeting the condition (iv) and the B content meeting the condition (v) are controlled as follows.

One of or the sum of some of the Ti, the Zr, the Hf and the Nb content: 0.030 to 0.50%

Titanium, zirconium, hafnium and niobium form carbonitrides. The carbonitrides are cable of effectively trapping hydrogen contained in the steel and of improving the hydrogen embrittlement resistance of the steel. The sum of the Ti, the Zr, the Hf and the Nb content of the special steel is 0.03% or above, preferably, 0.04% or above, most desirably, 0.05% or above. However, not only the toughness of the steel decreases, but also the amounts of N, O and S necessary for stabilizing the hydroxide generating elements cannot be secured if the sum of the Ti, the Zr, the Hf and the Nb content is excessively large. Therefore, an upper limit of the sum of the Ti, the Zr, the Hf and the Nb content is 0.50%, preferably, 0.3%, most desirably, 0.1%.

B content: 0.0005 to 0.01%

Segregation of boron occurs in austenitic grain boundaries to improve the hardenability of the steel and to shift the unrecrystallized gamma phase region toward the side of higher temperatures. Boron facilitates forming extended austenitic grains and extended austenitic grains improve hydrogen embrittlement resistance. Boron in a solid solution is concentrated in a high boron content in the surface of the steel piece and exercises a barrier effect on preventing the penetration of hydrogen into the steel to suppress the penetration of hydrogen into the steel. The barrier effect of B also improves hydrogen embrittlement resistance. More desirably, the lower limit B content is 0.001% or above. A deposit is precipitated in large grains in the steel if the B content of the steel is excessively high and causes stress concentration and reduces hydrogen embrittlement resistance. More desirably, an upper limit B content is 0.005% or below.

Elements V, Mo, Ni and Cr are not the essential components of the special steel. Recommended V, Mo, Ni and Cu contents are shown below.

Condition (vi): Sum or either of V content and Mo content is 2% or below.

Vanadium and molybdenum form carbonitrides to improve hydrogen embrittlement resistance by trapping hydrogen contained in the steel. Although the steel may contain those elements, an excessive V and/or Mo reduces the toughness of the steel and makes the steel unable to contain necessary amounts of N, O and S for stabilizing the hydroxide generating elements. Therefore, the upper limit of the sum of the V and the Mo content is 2%, preferably, 1.5%, most desirably, 1.0%. Although there is no lower limit of the sum of the V and the Mo content, the sum of the V and the Mo content may be, for example, 0.01% or above, preferably, 0.05% or above, most desirably, about 0.1% or above.

Condition (vii): Ni content is 2% or below and/or Cu content is 1% or below and above 0%.

Nickel and copper are effective in improving the corrosion resistance of the steel and do not promote corrosion pitting. Therefore, the steel may contain Ni and Cu so as to meet the condition (vii). Even if the Ni and the Cu content of the steel are increased beyond their upper limits, corrosion resistance improving effect saturates and the cost of the steel increases uselessly. Therefore, it is desirable that the Ni and the Cu content are not higher than their upper limits. Preferably, an upper limit Ni content is 1.5%, more desirably, 1.0%. Preferably, a lower limit Ni content is 0.01%, more desirably, 0.05%. Preferably, an upper limit Cu content is 0.8%, more desirably, 0.6%. A lower limit Cu content is 0.01%, more desirably, 0.05%.

The first and the second high-strength steel of the present invention and the special steels as preferable examples of the first and the second high-strength steel contain the foregoing chemical components, and most of other elements may be substantially Fe. The steels of the present invention may contain inevitable impurities, such as P, came from raw materials, materials, manufacturing equipment and such, and other elements, in contents that do not adversely affect achieving the objects of the present invention, for imparting other desired properties to the steels.

There are not particular restrictions on the method of manufacturing the high-strength steel of the present invention. The high-strength steels of the present invention may be manufactured by any one of generally known methods and previously proposed methods of manufacturing high-strength steels, such as high-strength spring steels, provided that the high-strength steels have a tensile strength, desirably, a fracture toughness, within the range specified by the present invention. A wire of the high-strength steel may be made by descaling a steel wire formed by hot wire drawing, forming the descaled steel wire in a predetermined diameter and a pre-determined shape by cold wire drawing, and tempering the steel wire by heating in a furnace. The steel wire may be tempered by quickly heating the steel wire by high-frequency induction heating or Joule heating. Tempering conditions, namely, conditions for austenitization quenching and tempering, need to be selectively determined according to the compositions of steels. The present invention does not place any restrictions on the method of making the high-strength steel because the high-strength steel contains only small amounts of Mg, Ca, Sr, Ba, Li, Na and K, which are important components of the high-strength steel of the present invention, and the effects of those elements are not scarcely dependent of the method of making the high-strength steel, and it is expected that the corrosion pitting suppressing effect of those elements are effective whether those elements are in grain boundaries or in grains and regardless of the structure of the steel. It is desirable that parts near the surface of the high-strength steel has Mg, Ca, Sr, Ba, Li, Na and K contents not lower than predetermined values, respectively. The parts near the surface of the high-strength steel may be examined to ensure that there is not apparent reduction in the Mg, Ca, Sr, Ba, Li, Na and K contents.

The hydrogen embrittlement resistance may be evaluated by any suitable method. The high-strength steel may be tested for hydrogen embrittlement resistance by any one of a constant-strain rate test, a constant-loading rate test and a slow strain rate test. Hydrogen may be made to penetrate into the steel by corrosion by any one of an acid dipping method, a method using a salt spray testing machine and a method using CCT testing machine. It is desirable carry out the slow strain rate test at a crosshead speed of 2 μm/min or below and to compare a specimen of a steel penetrated by hydrogen and a specimen of a steel not penetrated by hydrogen with respect to fracture stress and strain. It is difficult to determine the quantity of hydrogen penetrated into the steel directly by quantitative analysis at present. The amount of hydrogen occluded by the steel in a corrosive environment can be electrochemically determined or can be electrochemically determined by making hydrogen penetrated into the steel in a corrosive environment penetrate through the steel and measuring the amount of hydrogen penetrated through the steel. The steel repeats the absorbs and emission of hydrogen. Therefore, the measured amount of hydrogen penetrated into the steel is not reliable even if the measured amount of hydrogen penetrated internal combustion engine the steel is estimated from the amount of occluded hydrogen or hydrogen penetrated through the steel measured at a time point. Therefore, it is desirable to employ the foregoing subjective hydrogen embrittlement resistance evaluating method.

Corrosion resistance evaluating method may be any one of or a combination of some of various test methods including an atmospheric corrosion test, an acid solution dipping test, a salt spraying test and a constant-temperature constant-humidity test. Preferably, the corrosion resistance of the steel is tested in an environment of conditions similar to those of an environment in which the steel is expected to be used. For example, if the steel is intended to form automotive suspension springs, it is undesirable to dip the steel in a strong acid solution. It is desirable to evaluate the corrosion resistance of the steel by a combined cycle corrosion test including salt spraying and wetting.

EXAMPLES

The invention will be more concretely described in terms of examples of the high-strength steels embodying the present invention. It is to be understood that the following examples are not restrictive.

Experiments Nos. 1 to 26

Test steels each of 150 kg in weight containing chemical components in quantities (percent by mss) shown in Table 1 and containing Fe and inevitable impurities as others were melted in a vacuum melting furnace. The molten test steels were cast to obtain 150 kg ingots, and the ingots were cooled. Each of the ingots was forged into a 25 mm diameter steel bar. The steel bar was processed by drawing to obtain a 12.5 mm diameter steel rod. Then, the steel rod was subjected to quenching and tempering to adjust its hardness to hardness between HRC 55 and HRC 57.

Figure 2:
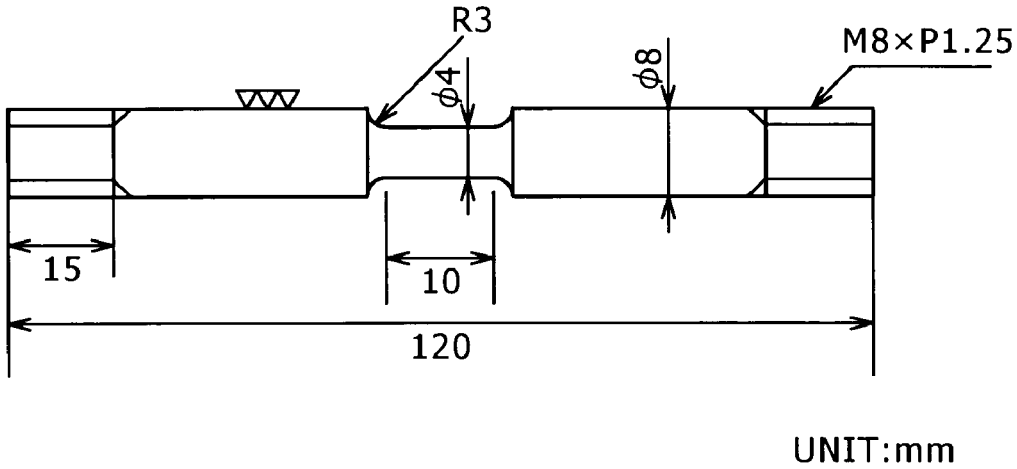
FIG. 2 is a plan view of a specimen for the evaluation of hydrogen embrittlement resistance.

Hydrogen embrittlement resistance specimens shown in FIG. 2 for hydrogen embrittlement resistance test, corrosion specimens of 10 mm in diameter and 10 mm in length for corrosiveness and corrosion pit measuring test, namely, CT specimens, and fracture toughness specimens for fracture toughness test were cut out from each of the test steels. Each of the fracture toughness specimens was made by forming a fatigue precrack whose length is 3 mm in a specimen similar to the CT specimen.

Experiments Nos. 9, 10, 16, 17, 25 and 26 determined surface treatment length ratios shown in Table 2 dipped the specimen in an aqueous solution containing 20 g/l Ca ions, and 50 g/l Mg ions, connected the specimen to the negative terminal of a power supply and a current of 1 A/dm$^2$ for a time between 30 and 300 min through the specimen for electrolysis to deposit a mixed layer of $CaCO_3$ and $Mg(OH)_2$ on the surface of the specimen. The surface treatment length ratio was determined by the foregoing method.

Fracture toughness (KIC) was measured by a tensile tester at a room temperature in the atmosphere. KICs of 40 MPa√m or above were evaluated to be satisfactory, and those of 50 MPa √m or above were evaluated very high.

The hydrogen embrittlement resistance test was conducted in the following manner. The specimen of the shape shown in FIG. 2 was degreased by ultrasonic degreasing using acetone, the threaded part of the specimen was coated with a resin. Then, the specimen was subjected to fourteen cycles of a 24 hr test including an 8 hr salt spraying step using 5% salt solution and a 16 hr wetting step in an atmosphere of a temperature of 35° C. and a humidity of 60%. Then, the specimen was tested by a SSRT test at a crosshead speed of $2\times10^{-3}$ mm/min on a SSRT tester to measure the breaking strength of the specimen. The specimens having a breaking strength of 1200 MPa or below were evaluated to be inferior in hydrogen embrittlement resistance, those having a breaking strength of 1400 MPa were evaluated to be satisfactory in hydrogen embrittlement resistance, and those having a breaking strength of 1600 MPa were evaluated to be excellent in hydrogen embrittlement resistance.

The corrosion resistance test used specimens of 10 mm×mm×1 mm (thickness). The weight W1 of the specimen and the area S (approximately 500 mm$^2$) of a part of 10 mm×50 mm of the surface of the specimen were measured.

Then, the specimen of the was degreased by ultrasonic degreasing using acetone, one of the two flat, major surfaces of the specimen was coated with a resin, and then the specimen was subjected to fourteen cycles of the foregoing corrosion process. After removing the resin coating the surface of the specimen, the specimen was subjected repeatedly to a dipping process for dipping the specimen in an aqueous solution containing 180 g/l NaOH and 30 g/l $KMnO_4$ and an electrolysis process that dips the specimen in an aqueous solution containing 100 g/l $(NH_4)_2HC_6H_5O_7$ connects the specimen to the negative terminal of a power supply and supplies a current of 1 A/dm$^2$ or above through the specimen to remove rust chemically from the specimen. Then, the weight W2 of the specimen was measured. Then, a corrosion weight reduction: (W1−W2)/S was calculated. Each of corrosion weight reductions shown in Table 2 is the mean of those of three specimens of each of the test steels.

The specimen tested by the corrosion test was embedded in a resin block. The resin block was cut to expose a section of the specimen, the section of the specimen was observed under an optical microscope at a magnification of 100× and the mean reference line was drawn in an irregular boundary line between the resin and the specimen. Then, the depth of the deepest pit was measured with the optical microscope at a magnification of 400×. Ten parts of each specimen were observed. Each of pit depths shown in Table 2 is the mean of thirty measured pit depths of ten parts of each of three specimens of each test steel.

The steels having a corrosion weight reduction of 900 g/m$^2$ or below and a corrosion pit depth of 75 μm or below can grade satisfactory in corrosion resistance, and those having a corrosion weight reduction of 700 g/m$^2$ or below and a corrosion pit depth of 50 μm or below can grade excellent in corrosion resistance.

TABLE 1

| Specimen | C | Si | Cr | Mn | Mg | Ca | Sr, Ba, Li, Na, K | Cr + (Mn/4) | Value of the right side of the expression | N |
|---|---|---|---|---|---|---|---|---|---|---|
| A | 0.49 | 1.71 | 0.45 | 0.48 | 0.0028 | — | — | 0.57 | 1.40 | 0.0038 |
| B | 0.53 | 2.00 | 0.55 | 0.15 | — | — | — | 0.59 | 0.00 | 0.0040 |
| C | 0.40 | 2.02 | 2.25 | 0.25 | — | 0.0018 | — | 2.31 | 1.80 | 0.0035 |
| D | 0.42 | 1.98 | 5.27 | 0.25 | 0.0035 | 0.0045 | — | 5.33 | 6.25 | 0.0038 |
| E | 0.61 | 2.24 | 0.75 | 1.19 | 0.0017 | 0.0025 | — | 1.05 | 3.35 | 0.0047 |
| F | 0.75 | 1.55 | 0.90 | 0.20 | 0.0025 | 0.0015 | — | 0.95 | 2.75 | 0.0045 |
| G | 0.41 | 0.52 | 1.02 | 0.24 | — | 0.0018 | — | 1.08 | 1.80 | 0.0057 |
| H | 0.63 | 2.98 | 2.46 | 0.55 | 0.0024 | 0.0018 | — | 2.60 | 3.00 | 0.0064 |
| I | 0.38 | 1.95 | 1.41 | 0.22 | 0.0011 | — | Sr: 0.0015<br>Li: 0.0015 | 1.47 | 1.49 | 0.0125 |
| J | 0.65 | 2.12 | 3.51 | 0.15 | 0.0019 | 0.0026 | Na: 0.0004<br>K: 0.0004 | 3.55 | 3.65 | 0.0051 |
| K | 0.42 | 1.75 | 0.97 | 0.25 | — | 0.0010 | Ba: 0.0005<br>Li: 0.0021 | 1.03 | 1.51 | 0.0039 |
| L | 0.51 | 1.82 | 4.12 | 0.10 | — | 0.0049 | — | 4.15 | 4.90 | 0.0057 |
| M | 0.45 | 1.49 | 2.02 | 0.21 | 0.0049 | — | — | 2.07 | 2.45 | 0.0040 |
| N | 0.38 | 2.45 | 1.25 | 0.20 | 0.0031 | — | — | 1.30 | 1.55 | 0.0051 |
| O | 0.65 | 1.02 | 2.18 | 0.15 | — | 0.0025 | — | 2.22 | 2.50 | 0.0055 |
| P | 0.41 | 1.75 | 1.05 | 0.19 | — | 0.0014 | Ba: 0.0004 | 1.10 | 1.60 | 0.0040 |
| Q | 0.53 | 1.48 | 4.16 | 0.52 | 0.0015 | 0.0035 | Sr: 0.0007 | 4.29 | 4.60 | 0.0040 |
| R | 0.40 | 1.98 | 1.40 | 0.21 | 0.0020 | 0.0020 | — | 1.45 | 3.00 | 0.0035 |
| S | 0.45 | 2.10 | 1.01 | 0.15 | 0.0015 | 0.0012 | — | 1.05 | 1.95 | 0.0051 |
| T | 0.52 | 2.39 | 1.01 | 0.18 | 0.0018 | 0.0018 | — | 1.06 | 2.70 | 0.0044 |

| Specimen | O | S | V | Mo | V + Mo | Ti, Zr, Hf, Nb | B | Ni | Cu | Remarks a) |
|---|---|---|---|---|---|---|---|---|---|---|
| A | 0.0017 | 0.005 | 0.16 | — | 0.16 | Ti: 0.073 | — | — | — | A |
| B | 0.0013 | 0.007 | 0.11 | — | 0.11 | Ti: 0.061 | — | — | — | A |
| C | 0.0010 | 0.003 | 0.15 | 0.12 | 0.27 | Ti: 0.047 | — | — | — | A |
| D | 0.0020 | 0.010 | 0.10 | — | 0.10 | Ti: 0.075 | — | — | — | A |
| E | 0.0015 | 0.009 | — | 0.20 | 0.20 | Ti: 0.048 | — | — | — | A |
| F | 0.0017 | 0.003 | 0.10 | 0.10 | 0.20 | Ti: 0.091 | — | — | — | A |
| G | 0.0035 | 0.005 | 0.12 | 0.10 | 0.22 | Ti: 0.072 | — | — | — | A |
| H | 0.0025 | 0.004 | 0.15 | 0.75 | 0.90 | Ti: 0.066 | — | — | — | A |
| I | 0.0014 | 0.006 | 0.15 | 0.05 | 0.20 | Ti: 0.070 | — | — | — | B |
| J | 0.0088 | 0.012 | 0.09 | — | 0.09 | Ti: 0.055 | — | — | — | B |
| K | 0.0021 | 0.041 | 0.18 | 0.11 | 0.29 | Ti: 0.071 | — | — | — | B |
| L | 0.0015 | 0.005 | — | — | — | Ti: 0.54 | — | — | — | B |
| M | 0.0013 | 0.004 | 1.00 | 1.20 | 2.20 | Ti: 0.025 | — | — | — | B |
| N | 0.0016 | 0.006 | 0.15 | — | 0.15 | Ti: 0.072<br>Hf: 0.005 | — | — | — | C |
| O | 0.0012 | 0.004 | 0.24 | 0.10 | 0.34 | Ti: 0.065<br>Nb: 0.002 | — | — | — | C |
| P | 0.0012 | 0.004 | 0.17 | — | 0.17 | Ti: 0.071 | — | 0.51 | 0.18 | C |
| Q | 0.0011 | 0.005 | 0.10 | — | 0.10 | Ti: 0.010<br>Zr: 0.040 | — | 0.30 | — | C |
| R | 0.0018 | 0.003 | 0.17 | 1.25 | 1.42 | Ti: 0.057 | 0.0015 | 0.10 | 0.25 | C |
| S | 0.0021 | 0.004 | 0.09 | 0.10 | 0.19 | Ti: 0.066 | 0.0018 | 0.41 | 0.05 | C |
| T | 0.0010 | 0.004 | — | — | — | Ti: 0.048 | 0.0012 | 0.62 | 0.58 | C |

A: Steel in comparative example, B: First high-strength steel, C: First high-strength steel (special steel)

TABLE 2

| Experiment No. | Specimen No. 1) | | Tensile strength ($N/mm^2$) | Surface treatment length ratio (%) | Fracture toughness (MPa√m) | Corrosion resistance: Corrosion weight reduction ($g/m^2$) | Corrosion resistance: Depth of corrosion pit (μm) | Hydrogen embrittlement resistance Breaking strength (MPa) | Remarks 2) |
|---|---|---|---|---|---|---|---|---|---|
| 1 | A | a | 1920 | — | 46 | 1081 | 48 | 1001 | d |
| 2 | B | a | 1904 | — | 43 | 991 | 115 | 929 | d |
| 3 | C | a | 1899 | — | 53 | 822 | 79 | 1183 | d |
| 4 | D | a | 1907 | — | 51 | 799 | 82 | 1017 | d |
| 5 | E | a | 1902 | — | 41 | 941 | 75 | 993 | d |
| 6 | F | a | 1941 | — | 30 | 790 | 27 | 810 | d |
| 7 | G | a | 1896 | — | 54 | 989 | 41 | 1150 | d |
| 8 | H | a | 1913 | — | 38 | 777 | 39 | 975 | d |
| 9 | B | a | 1921 | 12.0 | 43 | 966 | 111 | 1026 | d |
| 10 | B | a | 1900 | 25.0 | 43 | 891 | 53 | 1220 | e |
| 11 | I | b | 1889 | — | 55 | 869 | 49 | 1255 | f |
| 12 | J | b | 1892 | — | 40 | 826 | 59 | 1281 | f |
| 13 | K | b | 1911 | — | 52 | 895 | 40 | 1312 | f |
| 14 | L | b | 1904 | — | 44 | 805 | 54 | 1309 | f |
| 15 | M | b | 1930 | — | 48 | 845 | 45 | 1371 | f |
| 16 | L | b | 1890 | 21.8 | 44 | 794 | 49 | 1451 | g |
| 17 | M | b | 1895 | 50.6 | 48 | 661 | 38 | 1560 | g |
| 18 | N | c | 1931 | — | 53 | 791 | 55 | 1536 | h |
| 19 | O | c | 1912 | — | 40 | 850 | 59 | 1408 | h |
| 20 | P | c | 1901 | — | 54 | 696 | 41 | 1603 | h |
| 21 | Q | c | 1888 | — | 43 | 535 | 48 | 1620 | h |
| 22 | R | c | 1902 | — | 52 | 572 | 37 | 1622 | h |
| 23 | S | c | 1931 | — | 50 | 523 | 44 | 1621 | h |
| 24 | T | c | 1926 | — | 44 | 440 | 28 | 1627 | h |
| 25 | R | c | 1940 | 27.1 | 52 | 517 | 21 | 1631 | i |
| 26 | S | c | 1913 | 71.3 | 50 | 451 | 15 | 1645 | i |

1) a: Steel in comparative example, b: First high-strength steel, c: First high-strength steel (Special steel), 2) d: Comparative example, e: second high-strength steel, f: First high-strength steel, g: Third high-strength steel, h: First high-strength steel (Special steel), i: Third high-strength steel (Special steel)

The specimen for Experiment No. 1 had a low Cr content and the corrosion weight reduction thereof was large. However, the depth of the corrosion pit was comparatively small because the steel contained the hydroxide generating elements. The specimen for Experiment No. 2 contained none of the hydroxide generating elements and did not meet the condition (2) represented by Expression (1). The depth of the corrosion pit of the specimen was the greatest among those of the specimens used by the experiments. The specimen for Experiment No. 3 contained the hydroxide generating elements in low contents as compared with the Cr and the Mn content thereof, and did not meet the condition (2) represented by Expression (1). The depth of the corrosion pit in the specimen for Experiment No. 3 was big. The specimens for Experiments Nos. 4 and 5 had a high Cr content and a high Mn content, respectively. The corrosion pit growth suppressing effect of the hydroxide generating elements contained in the specimens for Experiments Nos. 4 and 5 was unsatisfactory.

Each of the specimens for Experiments Nos. 6 and 8 had a high C content and a high Si content, and met the condition (2) represented by Expression (1). Therefore, the depths of corrosion pits in the specimens for Experiments Nos. 6 and 8 were small, but the fracture toughness thereof was low and the hydrogen embrittlement resistance thereof was bad. The specimen for Experiment No. 7 had a low Si content and a Cr content within the content rage specified by the present invention. However, the specimen had a large corrosion weight reduction and bad hydrogen embrittlement resistance. A specimen for Experiment No. 9 was prepared by coating the surface of the specimen for Experiment No. 2 with a compound layer containing the hydroxide generating elements. The amount of the compound layer was insufficient, i.e., the compound layer had an excessively low surface treatment length ratio, and the effect of the compound layer on the improvement of hydrogen embrittlement resistance was unsatisfactory. A specimen for Experiment No. 10 was prepared by coating the surface of the specimen for Experiment No. 2 with a compound layer containing proper amounts of the hydroxide generating elements. The specimen for Experiment No. 1 had corrosion pits of a very small depth and had considerably improved hydrogen embrittlement resistance.

Specimens used for Experiments Nos. 11 to 15 were those of the first high-strength steel of the present invention, but were not those of the special steels among the first high-strength steels. As compared with the steels in comparative examples for Experiments Nos. 1 to 6, steels for Experiments Nos. 11 to 15 had considerably improved hydrogen embrittlement resistance. The specimens for Experiments Nos. 16 and 17 obtained by coating the surfaces of the specimens for Experiments Nos. 14 and 15 with compound layers containing the hydroxide generating elements, respectively, had considerably improved hydrogen embrittlement resistance.

Specimens used for Experiments Nos. 18 to 24 were those of the special steels among the first steels. The specimens for Experiments Nos. 20 to 24 in particular are those of the special steels each having a proper Ni content and/or a proper Cu content. The specimens for Experiments Nos. 18 to 24 (particularly, the specimens for Experiments Nos. 20 to 24) were excellent in corrosion resistance and hydrogen embrittlement resistance. Specimens for Experiments Nos. 25 and 26 formed by coating the surfaces of the special steels with compound layers containing the hydroxide generating elements, respectively, were very excellent in corrosion resistance and hydrogen embrittlement resistance.

Industrial Applicability

The first to the third high-strength steels of the present invention are excellent in corrosion resistance and hydrogen embrittlement resistance and are optimum steels for use as high-strength spring steels for forming steel springs for use under severe conditions causative of corrosion and fatigue. The first to the third high-strength steel can be applied to forming steel parts including gears, sliding members, shafts, bearings and such for automobiles construction machines and industrial machines as well as to automotive parts including gears, bolts and such.

The invention claimed is:

1. A high-strength steel having a surface compound layer thereon, wherein:

(A) the high-strength steel has a tensile strength not lower than 1800 N/mm$^2$ and consists essentially of:

C in an amount of 0.3 to 0.65 percent by mass;

Cr in an amount of 0.95 to 5.0 percent by mass;

Mn in an amount of 0.05 to 0.6 percent by mass;

Si in an amount of 0.7 to 2.5 percent by mass;

at least one of Mg, Ca, Sr, Ba, Li, Na and K so as to meet the following conditions:

(1) the upper limit of the Mg, Ca, Sr, Ba, Li, Na and K content is 0.05% each, and (2) the Mg, Ca, Sr, Ba, Li, Na and K content meet expression (I)

$$Cr + \frac{Mn}{4} \leq 1000 \times \left[Ca + \frac{Mg + Sr + Ba}{2} + \frac{Li + Na + K}{8}\right] \quad (I)$$

where the respective Mg, Ca, Sr, Ba, Li, Na and K contents are in percent by mass of the high strength steel; and balance of iron and inevitable impurities; and (B) the surface compound layer comprises at least one compound of at least one element selected from the group consisting of Mg, Ca, Sr, Ba, Li, Na and K, and occupies at least 20% of a unit length of a section of the steel in an observation field or above.

2. The high-strength steel having a surface compound layer thereon according to claim 1, wherein the surface compound layer comprises $Mg(OH)_2$ and $CaCO_3$.

3. The high-strength steel having a surface compound layer thereon according to claim 1, wherein the high-strength steel further comprises 0.002 to 0.010% N, 0.0005 to 0.005% O, and 0.001 to 0.0025% S, and meeting at least either of the following conditions (a) and (b):

(a) the high-strength steel further comprises at least one of Ti, Zr, Hf and Nb in a content between 0.030 and 0.50%, and (b) the high-strength steel further comprises B in a content between 0.0005 and 0.01%.

4. The high-strength steel having a surface compound layer thereon according to claim 1, wherein the high-strength steel further comprises V and/or Mo in a content not higher than 2% and higher than 0%.

5. The high-strength steel having a surface compound layer thereon according to claim 1, wherein the high-strength steel further comprises Ni in a content not higher than 2.0% and higher than 0% and/or Cu in a content not higher than 1.0% and higher than 0%.

6. The high-strength steel having a surface compound layer thereon according to claim 1, wherein the high-strength steel has a fracture toughness (KIC) of 40 Mpa$\sqrt{m}$ or above.

7. A high-strength steel having a surface layer thereon, wherein:

(1) the high-strength steel has a tensile strength not lower than 1800 N/mm$^2$ and consists essentially of:

C in an amount of 0.3 to 0.65 percent by mass;

Cr in an amount of 1.5 to 5.0 percent by mass;

Mn in an amount of 0.05 to 0.6 percent by mass; and

Si in an amount of 0.7 to 2.5 percent by mass; and the balance of iron and inevitable impurities; and (2) the surface layer comprises at least one hydroxide generating element selected from the group consisting of Mg, Ca, Sr, Ba, Li, Na and K, and at least one compound of an element selected from the group consisting of Mg, Ca, Sr, Ba, Li, Na and K, and the surface layer occupies at least 20% of a unit length of a section of the steel in an observation field or above.

8. The high-strength steel according to claim 7, wherein the surface layer comprises a compound selected from the group consisting of $Mg(OH)_2$, $CaCO_3$, or mixtures thereof.

9. The high-strength steel according to claim 1, wherein the surface compound layer comprises a compound selected from the group consisting of $Mg(OH)_2$, $CaCO_3$, and mixtures thereof.

10. The high-strength steel having a surface compound layer thereon according to claim 7, wherein the surface compound layer comprises $Mg(OH)_2$ and $CaCO_3$.

* * * * *